US006585544B2

(12) United States Patent
Furutani

(10) Patent No.: US 6,585,544 B2
(45) Date of Patent: Jul. 1, 2003

(54) TERMINAL FITTING

(75) Inventor: Mitsugu Furutani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/058,668

(22) Filed: Jan. 28, 2002

(65) Prior Publication Data

US 2002/0115311 A1 Aug. 22, 2002

(30) Foreign Application Priority Data

Feb. 19, 2001 (JP) ..... 2001-042122

(51) Int. Cl.[7] ..... H01R 11/52
(52) U.S. Cl. ..... 439/852; 439/252
(58) Field of Search ..... 439/852, 850, 439/851, 374, 252, 249, 843, 849

(56) References Cited

U.S. PATENT DOCUMENTS 5,611,717 A * 3/1997 Joly ..... 439/857

FOREIGN PATENT DOCUMENTS

WO WO 98/29924 7/1998

OTHER PUBLICATIONS

2002/0160666 Sato et al. Oct. 31, 2002 Electrical Contact.*

* cited by examiner

*Primary Examiner*—Neil Abrams
*Assistant Examiner*—Phuong K T Dinh
(74) *Attorney, Agent, or Firm*—Anthony J. Casella; Gerald E. Hespos

(57) ABSTRACT

A terminal fitting has a resilient contact piece (18) coupled to an inner ceiling wall (15) via a resilient supporting piece (17). The resilient contact piece (18) is cantilevered back from the resilient supporting piece (17) and then is bent forward. A portion of the resilient contact piece (17) is resiliently deformable upward and downward with a folded portion (20) as a center. The resilient contact piece (18) is entirely displaceable along the longitudinal direction with the resilient supporting piece (17) as a center. An auxiliary spring portion (30) has a first and a second curves (32) that project up and down immediately before the folded portion (20) of the resilient contact piece (18). The auxiliary spring portion (30) can be elongated and contracted resiliently along the same direction.

12 Claims, 5 Drawing Sheets

TERMINAL FITTING

BACKGROUND OF THE INVENTION

1. Field of the Invention

The invention relates to a terminal fitting that prevents fine sliding abrasion.

2. Detailed Description of the Related Art

Terminal fittings often are used in a high vibration environment. The vibration may cause the contact portions of the terminal fittings to undergo a fine sliding abrasion, and hence electrical resistance at the contact portions may increase. A terminal fitting designed to prevent fine sliding abrasion is disclosed in WO 98/29924 and also is identified by the numeral 1 in FIG. 6 herein. The terminal fitting 1 has a rectangular tubular connecting portion 6 for receiving a mating male tab 9. The connecting portion 6 has a side wall 2 that is cut to form a resilient supporting piece 3. The connecting portion 6 also has a ceiling surface that is formed to define a receiving portion 4 that is coupled to the resilient supporting piece 3. A resilient contact piece 5 extends from the receiving portion 4 and cooperates with the receiving portion 4 to squeeze the male tab 9. The male tab 9 may undergo a fine vibration longitudinally along its inserting direction into the connecting portion 6. However, the resilient supporting piece 3 deforms and permits the resilient contact piece 5 and the receiving portion 4 to follow the vibration along the longitudinal direction. Thus, fine sliding abrasion at the contact portions of the two terminals 1, 9 is alleviated.

The resilient supporting piece 3 extends up in FIG. 6 and then projects forward from the plane of FIG. 6 to couple with the receiving portion 4. Thus, the resilient contact piece 5 does not follow the male tab 9 satisfactorily.

The present invention was developed in view of the above situation, an object thereof is to provide a terminal fitting having a resilient contact piece which can satisfactorily follow up a male tab in contact therewith.

SUMMARY OF THE INVENTION

The invention is directed to a terminal fitting that comprises a connecting portion into which a mating male terminal is insertable. A resilient contact piece is provided in the connecting portion and extends substantially in a longitudinal direction. The resilient contact piece is resiliently deformable in a direction that intersects the longitudinal direction and includes a contact that can be brought electrically into contact with the mating male terminal. The resilient contact piece is displaceable along the longitudinal direction or the insertion direction of the male tab. Accordingly, the resilient contact piece can easily follow a displacement of the male tab along the longitudinal or insertion direction.

A resilient supporting piece couples a lateral edge of the resilient contact piece to a side wall of the connecting portion, thereby enabling longitudinal displacement of the resilient contact piece with the resilient supporting piece as a center.

The resilient supporting piece preferably is separated from the side wall by a pair of slits. Hence, the resilient supporting piece projects sideways along a direction that intersects the longitudinal direction.

Additionally, the resilient supporting piece preferably is covered at least partly by an outer side wall arranged outward of the side wall.

The terminal fitting may further comprise an auxiliary spring between the contact and a portion of the resilient contact piece coupled to the side wall of the connecting portion, preferably the resilient supporting piece. The auxiliary spring preferably is resiliently displaceable along the longitudinal direction.

The male terminal engages the contact and deforms the resilient contact piece. The resilient contact piece and the auxiliary spring are displaced longitudinally with the resilient supporting piece as a center if the connected male terminal vibrates longitudinally. Thus, the resilient contact piece vibrates longitudinally as the male terminal vibrates and the contacts of the two terminals do not undergo a fine sliding abrasion.

The auxiliary spring is at an intermediate position of the resilient contact piece and extends longitudinally along the resiliently displacing direction. Thus the auxiliary spring is displaced smoothly, thereby improving its capability of following up the male terminal.

The auxiliary spring is backward from the contact with respect to an inserting direction of the mating male terminal. Thus, the mating male terminal can be inserted forcibly into the connecting portion without interfering with the auxiliary spring, and the auxiliary spring can display its spring force reliably.

The auxiliary spring preferably comprises at least one curve. Intervals defined by the respective curves can be narrowed and widened to allow the resilient contact piece to be displaced along the longitudinal direction.

The curve preferably is more inward than a corresponding lateral wall of the connecting portion and/or is more outward than the contact portion.

A lateral wall of the connecting portion may have a hole that partly overlaps the auxiliary spring, so that the auxiliary spring is exposed to outside.

The resilient contact piece preferably comprises a straight portion extending substantially parallel to the longitudinal direction. Thus, the auxiliary spring extends parallel to the longitudinal direction, and is displaced smoothly, as compared, for example, to a case where the auxiliary spring extends oblique to the longitudinal direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
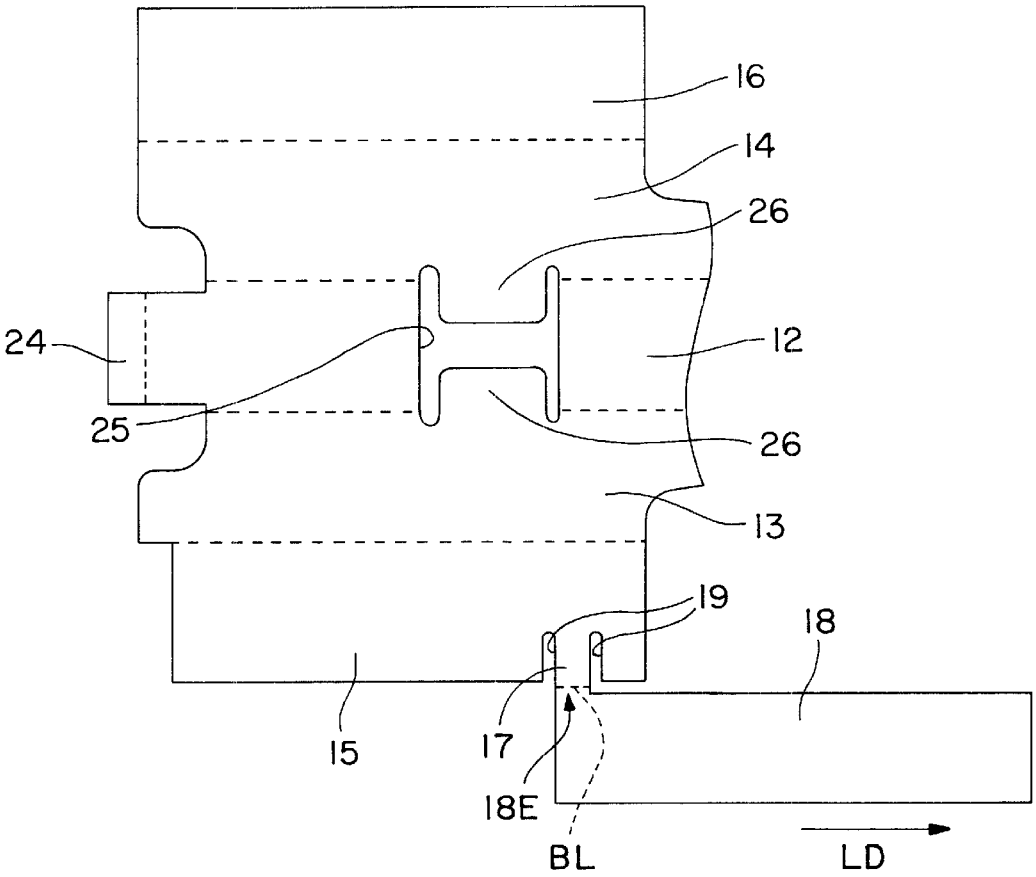
FIG. 1 is a development of a connecting portion of a terminal fitting according to one embodiment of the invention.
Figure 2:
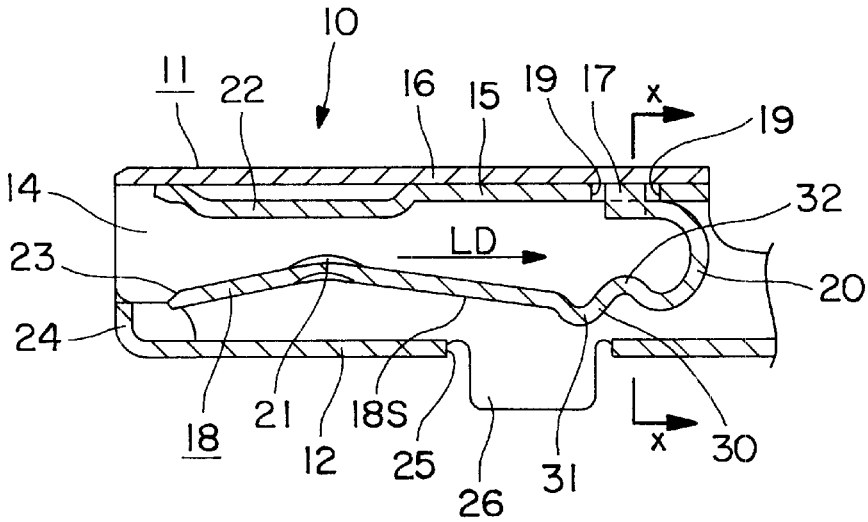
FIG. 2 is a side view in section of the connecting portion.

A terminal fitting according to the invention is identified by the numeral 10 in FIGS. 1 to 5. The terminal fitting 10 has a substantially rectangular tubular connecting portion 11, as shown in FIG. 2, and an unillustrated crimping portion behind the connecting portion 11. The crimping portion can be crimped into connection with a wire, and the terminal fitting 10 then can be locked in a cavity formed in an unillustrated connector. A mating male tab terminal 40 of a mating connector can be inserted along an insertion direction ID into the connecting portion 11 for electrical connection with the terminal fitting 10.

Figure 3:
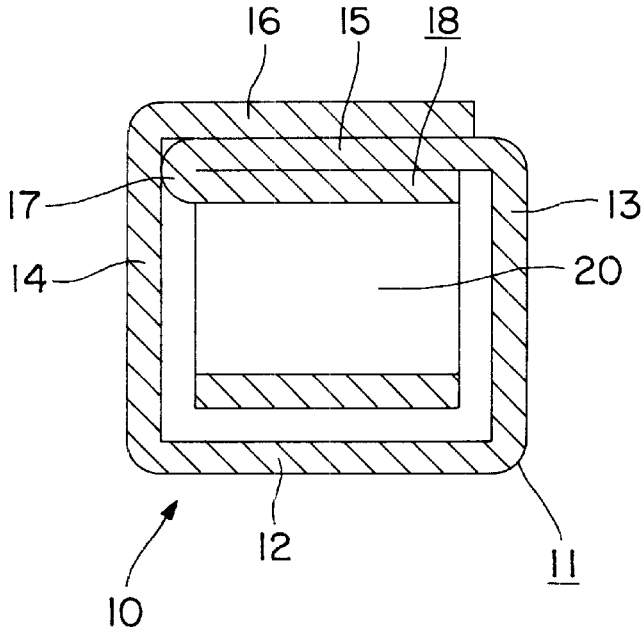
FIG. 3 is a section along 3—3 of FIG. 2.

The connecting portion 11 is formed by stamping, cutting or milling a metallic plate into the shape shown in FIG. 1 and then bending the metallic plate along the respective bending lines into the shape shown in FIGS. 2 and 3. This connecting portion 11, as shown in FIG. 3, has a bottom wall 12 and two side walls 13, 14 project from the opposite side edges of the bottom wall 12. An inner ceiling wall 15 projects from the upper end of the right side wall 13 of FIG. 3 and is bent left, and an outer ceiling wall 16 projects from the upper end of the left side wall 14 and is bent right. Thus, the outer ceiling wall 16 is placed on the outer surface of the inner ceiling wall 15.

A resilient contact piece 18 is disposed inside the connecting portion 11 and is connected at an edge portion 18E thereof with a resilient supporting piece 17 that projects from a rear portion of the inner ceiling wall 15. As shown in FIG. 2, the front end of the inner ceiling wall 15 is more rearward than the front end of the connecting portion 11 by a specified distance.

The resilient supporting piece 17 projects laterally substantially normal to the longitudinal direction of the terminal fitting 10 and is separated from a rear of the inner ceiling wall 15 by a pair of slits 19, as shown in FIG. 1. The projecting end of the resilient supporting piece 17 is coupled to a side end of the resilient contact piece 18. The resilient contact piece 18 is folded inside the inner ceiling wall 15 as shown in FIG. 2 by tightly bending the resilient supporting piece 17 inwardly along the bending line BL between the inner ceiling wall 15 and the resilient contact piece 18 (see FIG. 1). The resilient supporting piece 17 is substantially shorter than the inner ceiling wall 15 along extension or longitudinal direction LD. Thus, the resilient supporting piece 17 is resiliently displaceable along the longitudinal direction LD or along the insertion direction ID of the male terminal tab 40 for alternately narrowing the widths of the front and rear slits 19. Additionally, the resilient contact piece 18 is displaced with the resilient supporting piece 17 along the longitudinal direction LD, as shown FIG. 5. The resilient supporting piece 17 and the slits 19 are covered by the outer ceiling wall 16 and are not exposed to outside. Further, as shown in FIG. 1, the front surfaces of the resilient contact piece 18 and the resilient supporting piece 17 are substantially flush with each other.

The resilient contact piece 18 is cantilevered from the resilient supporting piece 18, as shown in FIGS. 1 and 2. More particularly, the resilient contact piece 18 initially is bent back to the rear end of the connecting portion 11 and then is bent forward. Thus, the resilient contact piece 18 has a substantially U-shape and extends forward and backward along the longitudinal direction of the terminal fitting 10. The center of the U-shape is defined by a fold 20, and a contact 21 is defined at the free end of the resilient contact piece 18 for electrically contacting the mating male tab terminal 40. The contact 21 is resiliently deformable vertically along a direction that is substantially normal to the longitudinal direction LD or insertion direction ID. Additionally, the contact 21 includes an upwardly bulged embossment. The contact 21 is coupled to the fold 20 by an auxiliary spring 30. The inner ceiling wall 15 faces the contact 21 from above and is formed with a receiving portion 22 that bulges down toward the contact 21 over a length slightly shorter than half the entire length of the connecting portion 11. The male tab terminal 40 inserted into the connecting portion 11 is squeezed between the receiving portion 22 and the contact 21 (see FIG. 4). A slanted surface 23 is formed at an upper edge of the front end (free end) of the resilient contact piece 18 to smooth insertion of the male tab terminal 40 into the connecting portion 11. The front end of the resilient contact piece 18 is slightly back from the front end of the inner ceiling wall 15. Further, the contact 21 faces a portion of the receiving portion 22 more backward than the center of the receiving portion 22.

A protection piece 24 extends up from the front end of the bottom wall 12 of the connecting portion 11 to substantially the same height or slightly higher than the front end of the resilient contact piece 18 for protecting the resilient contact piece 18. The bottom wall 12 has a locking hole 25 between the contact 21 and the fold 20, and a lock of the connector housing enters the locking hole 25 and engages the front edge thereof. Stabilizers 26 project down from the side walls 13, 14 at opposite sides of the locking hole 25. The stabilizers 26 enter guide grooves in the connector housing and guide the insertion of the terminal fitting 10.

The auxiliary spring 30 is immediately before the fold 20 and backward from the contact 21, as shown in FIG. 2., and is configured to be resiliently expandable and contractible along the longitudinal direction of the terminal fitting 10. More particularly, the auxiliary spring 30 is bent up and down into a wavy or undulated shape for a specified length along the resilient contact piece 18, and in the illustrated embodiment is comprised of a first curve 31 that projects down and a second curve 32 that projects up. The first and second curves 31, 32 are hairpin curves with specified intervals I1, I2 between their front and rear ends. The rear end of the first curve 31 is continuous with the front end of the second curve 32. Additionally, the bottom of the first curve 31 is higher than the upper surface of the bottom wall 12 (FIG. 2), and the top of the second curve 32 is lower than the contact 21. The front and rear ends (front end of the first curve 31 and rear end of the second curve 32) of the auxiliary spring 30 are at substantially the same height. Thus, the auxiliary spring 30 is at a substantially straight portion 18S of the resilient contact piece 18 that is substantially parallel with longitudinal direction LD and the auxiliary spring 30 extends substantially parallel with longitudinal direction LD or the insertion direction ID. Further, the auxiliary spring 30 partly overlaps the locking hole 25 so that it is exposed to outside via the locking hole 25.

Figure 5A:
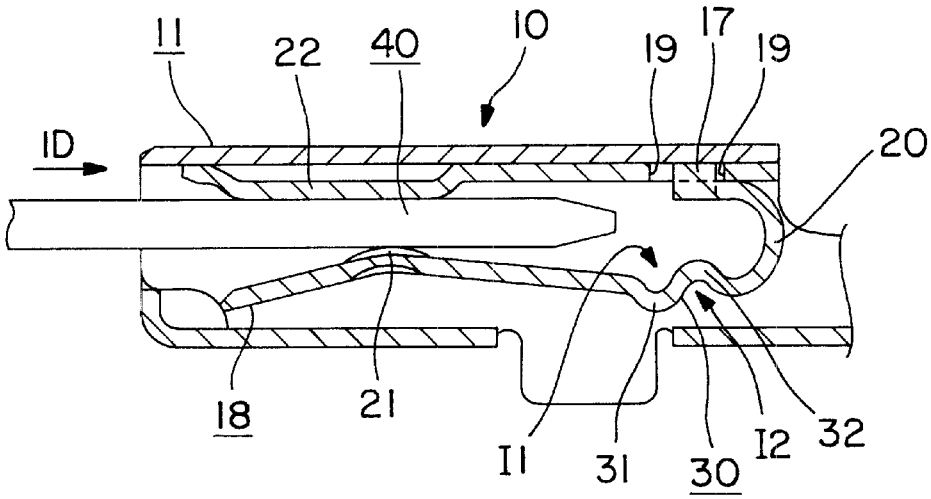
FIGS. 5(A) and 5(B) are cross-sectional views showing ranges of movement of the male tab terminal and the resilient contact piece.
Figure 5B:
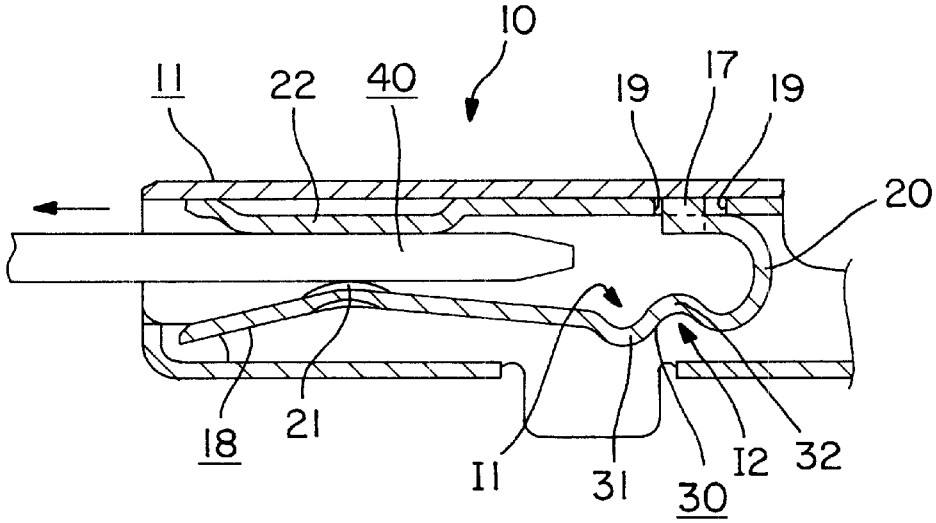
Figure 6:
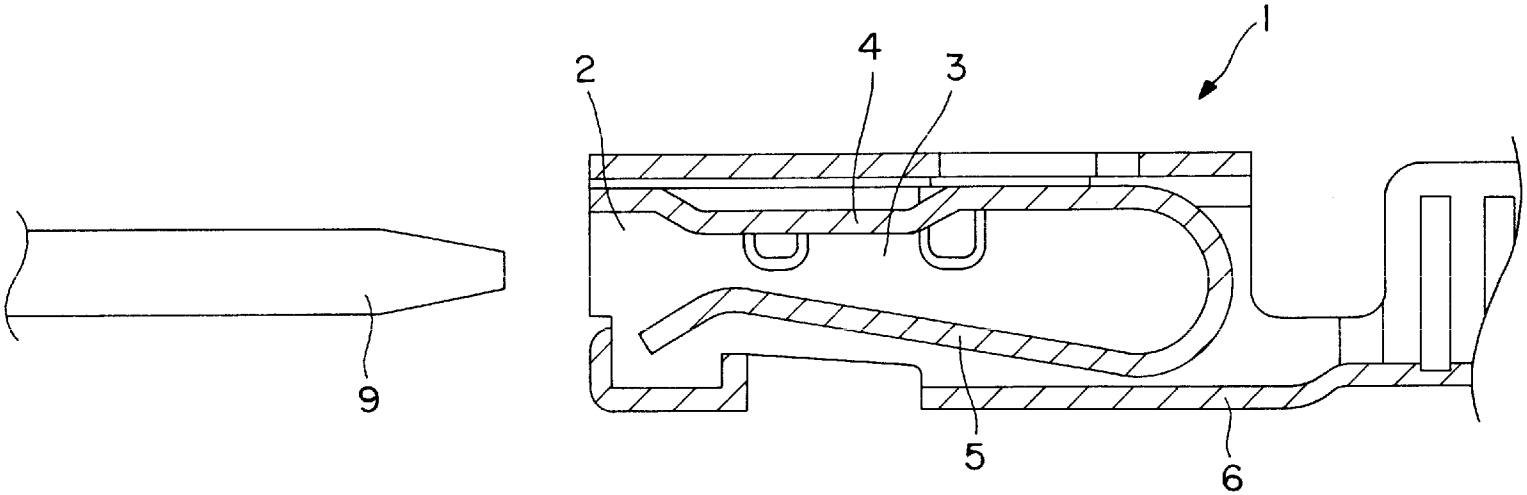
FIG. 6 PRIOR ART
FIG. 6 is a side view in section of a prior art terminal fitting.

A force acts that could cause the contact 21 of the resilient contact piece 18 to vibrate forward and back in the longitudinal direction, will cause the auxiliary spring 30 to contract and elongate elastically along the longitudinal direction LD or the insertion direction ID and to follow the vibration by widening and narrowing the intervals I1, I2 of the curves 31 and 32 (see FIG. 5). The contraction and elongation of the auxiliary spring 30 in this way, causes a portion of the resilient contact piece 18 before the auxiliary spring 30 (including the contact 21) to be displaced along the longitudinal direction with respect to the fold 20 and the portion coupled to the resilient supporting piece 17. Thus, the contact 21 is displaceable along the longitudinal direction to follow the vibration. The alignment of the auxiliary spring 30 substantially parallel with the longitudinal direction enables smooth extension and contraction.

Figure 4:
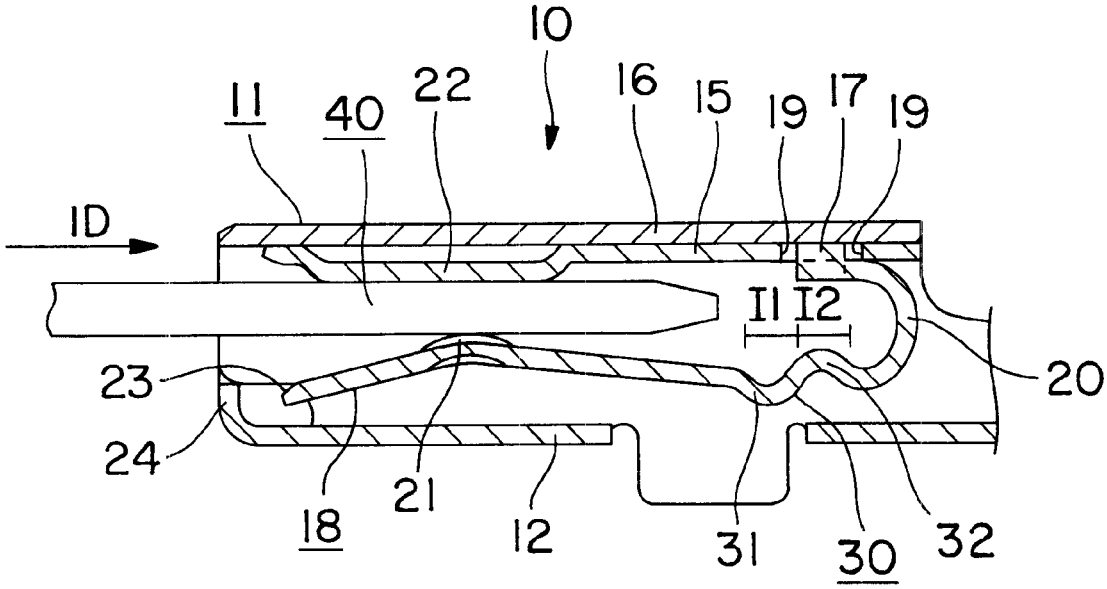
FIG. 4 is a side view in section showing a state where a male tab terminal is inserted into the connecting portion.

The mating male tab terminal 40 is inserted into the connecting portion 11 of the terminal fitting 10 from the front as the connectors are mated. Thus, the male tab terminal 40 moves between the receiving portion 22 and the resilient contact piece 18 and engages the contact 21. As a result, the resilient contact piece 18 is deformed resiliently about the fold 20 and the contact 21 moves down. The auxiliary spring 30 also is deformed resiliently at this time. Sufficient insertion enables the male tab terminal 40 to be squeezed between the receiving portion 22 and the contact 21, as shown in FIG. 4.

The connector may be subjected to external vibration in this state, and hence the male tab terminal 40 may undergo a fine vibration along the longitudinal direction LD or the insertion direction ID with respect to the terminal fitting 10. The resilient supporting piece 17 is deformed resiliently at this time and alternately narrows the widths of the front and rear slits 19, as shown in FIG. 5. Thus, the resilient contact piece 18 pressed in contact with the vibrating male tab terminal 40 vibrates in its entirety along longitudinal direction with the resilient supporting piece 17 as the center. Additionally, the auxiliary spring 30 expands and contracts resiliently along the longitudinal direction at an intermediate position of the resilient contact piece 18. Thus, the portion of the resilient contact piece 18 before the auxiliary spring 30, including the contact 21, vibrates along the longitudinal direction independently of the other portion. More specifically, the auxiliary spring 30 is expanded and contracted resiliently along the longitudinal direction by narrowing and widening the intervals I1, I2 between the front and rear ends of the first and second curves 31, 32. The resilient contact piece 18 vibrates along the longitudinal direction to follow and substantially synchronize with the vibration of the male tab terminal 40 by the resilient supporting piece 17 and the auxiliary spring 30 to prevent portions of the male tab terminal 40 and the contact 21 in contact with each other from experiencing a fine sliding abrasion. Although the distance of displacement of the male tab terminal 40 during vibration is actually a very short distance of about several microns, it is exaggerated in FIG. 5 to facilitate understanding of the present invention.

As described above, the auxiliary spring 30 is displaceable along the longitudinal direction due to movement the resilient supporting piece 17 relative to the slits 19 and the auxiliary spring 30 extends along and is displaceable along the longitudinal direction. Thus, the auxiliary spring 30 can be elongated and contracted smoothly in response to vibration of the male tab terminal 40, thereby improving the ability of the resilient contact piece 18 to follow the male tab terminal 40. Further, the alignment of the auxiliary spring 30 substantially parallel with longitudinal direction LD or insertion direction ID enables a smooth displacement as compared to a case where an auxiliary spring is on a section of the resilient contact piece 18 inclined to the longitudinal direction. Furthermore, the auxiliary spring 30 is backward from the contact 21 with respect to the inserting direction ID of the male tab terminal 40. Hence, there is no possibility that the male tab terminal 40 interferes with the auxiliary spring 30 to deform the auxiliary spring 30 even in the case that the male tab terminal 40 is inserted forcibly into the connecting portion 11. As a result, the auxiliary spring 30 can fulfill its function reliably.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The auxiliary spring portion is at a location on the resilient contact piece that is parallel to the longitudinal direction in the foregoing embodiment. However, it may be at a portion of the resilient contact piece that is between the parallel portion and the contact portion and is oblique to longitudinal direction.

The auxiliary spring portion is comprised of two curves having large curvatures like hairpin curves in the foregoing embodiment. However, it may be formed, for example, by bending the resilient contact piece into a leaf spring. Further, the number of the curves can be set arbitrarily.

The resilient supporting piece is separated from the inner ceiling wall by the slits in the foregoing embodiment. However, it may project, for example, from the lateral end of the inner ceiling wall by omitting the slits.

Although the fastening portion of the terminal fitting is behind the connecting portion in the foregoing embodiment, the present invention is also applicable to an insulation-displacement terminal fitting with an insulation-displacement portion having blades to be pressed into connection with a wire.

What is claimed is:

1. A terminal fitting, comprising:

a connecting portion into which a mating male terminal is insertable, a resilient contact piece disposed in the connecting portion and extending substantially in a longitudinal direction, and including a contact to be brought electrically into contact with the mating male terminal, the resilient contact piece being resiliently deformable in a direction intersecting with the longitudinal direction, the resilient contact piece further being displaceable along the longitudinal direction, and a resilient supporting piece coupling a lateral edge of the resilient contact piece to a side wall of the connecting portion, the resilient supporting piece projecting sideways along a direction intersecting the longitudinal direction and being partly separated from the side wall by a pair of slits, such that the resilient contact piece is displaceable along the longitudinal direction with the resilient supporting piece as a center.

2. The terminal fitting of claim 1, wherein the resilient supporting piece is covered by an outer side wall arranged outward of the side wall.

3. A terminal fitting comprising:

a connecting portion into which a mating male terminal is insertable, a resilient contact piece disposed in the connecting portion and extending substantially in a longitudinal direction, and including a contact to be brought electrically into contact with the mating male terminal, the resilient contact piece being resiliently deformable in a direction intersecting with the longitudinal direction, the resilient contact piece further being displaceable along the longitudinal direction, a resilient supporting piece coupling a lateral edge of the resilient contact piece to a side wall of the connecting portion, thereby making the resilient contact piece displaceable along the longitudinal direction with the resilient supporting piece as a center, and an auxiliary spring at a position on the resilient contact piece between the resilient supporting piece and the contact and being resiliently displaceable along the longitudinal direction.

4. The terminal fitting of claim 3, wherein the auxiliary spring is backward from the contact with respect to an inserting direction of the mating male terminal.

5. The terminal fitting of claim 4, wherein the auxiliary spring comprises a plurality curves, intervals defined by the curves can be narrowed and widened for allowing the resilient contact piece to be displaceable along longitudinal direction.

6. The terminal fitting of claim 5, wherein a first of the curves is more inwardly than a corresponding lateral wall of the connecting portion and wherein a second of the curves is more outwardly than the contact portion.

7. The terminal fitting of claim 3, wherein a lateral wall of the connecting portion is provided with a hole partly overlapping the auxiliary spring, so that the auxiliary spring is exposed to outside via the hole.

8. The terminal fitting of claim 1, wherein the resilient contact piece comprises a straight portion extending substantially parallel to the longitudinal direction.

9. A terminal fitting unitarily formed from a metallic material, and comprising:

a connecting portion into which a mating male terminal is insertable;

a resilient contact piece disposed in the connecting portion and extending substantially in a longitudinal direction, the resilient contact piece including a contact for electrically contacting the mating male terminal and being resiliently deformable in a direction intersecting the longitudinal direction in response to contact by the male terminal;

a resilient supporting piece coupling a lateral edge of the resilient contact piece to a side wall of the connecting portion for making the resilient contact piece displaceable along the longitudinal direction with the resilient supporting piece as a center; and an auxiliary spring at a position on the resilient contact piece between the resilient supporting piece and the contact and being resiliently displaceable along the longitudinal direction.

10. The terminal fitting of claim 9, wherein the auxiliary spring is backward from the contact with respect to an inserting direction of the mating male terminal.

11. The terminal fitting of claim 10, wherein the auxiliary spring comprises a plurality curves, intervals defined by the curves can be narrowed and widened for allowing the resilient contact piece to be displaceable along the longitudinal direction.

12. The terminal fitting of claim 9, wherein the auxiliary spring is substantially parallel to the longitudinal direction.

* * * * *